US012697522B2

(12) United States Patent
Lukanov

(10) Patent No.: US 12,697,522 B2
(45) Date of Patent: Aug. 4, 2026

(54) HYBRID RESISTANCE GENERATION SYSTEM FOR AN EXERCISE MACHINE

(71) Applicant: ATLETICA Deutschland GmbH, Mainz (DE)

(72) Inventor: Ivan Lukanov, Mainz (DE)

(73) Assignee: ATLETICA DEUTSCHLAND GMBH, Mainz (DE)

( * ) Notice: Subject to any disclaimer, the term of this patent is extended or adjusted under 35 U.S.C. 154(b) by 56 days.

(21) Appl. No.: 18/893,131

(22) Filed: Sep. 23, 2024

(65) Prior Publication Data

US 2026/0027400 A1 Jan. 29, 2026

(30) Foreign Application Priority Data

Jul. 23, 2024 (EP) ..... 24190477

(51) Int. Cl.
*A63B 21/00* (2006.01)
*A63B 21/005* (2006.01)
*A63B 24/00* (2006.01)

(52) U.S. Cl.
CPC .... *A63B 21/00065* (2013.01); *A63B 21/0058* (2013.01); *A63B 21/153* (2013.01); *A63B 21/154* (2013.01); *A63B 24/0087* (2013.01)

(58) Field of Classification Search
CPC ..... A63B 21/00065; A63B 21/05; A63B 21/0058; A63B 21/0059; A63B 21/0628; A63B 21/153; A63B 21/154; A63B 24/0087; A63B 2024/0093; A63B 71/0619; A63B 2220/805
See application file for complete search history.

(56) References Cited

U.S. PATENT DOCUMENTS 5,328,429 A * 7/1994 Potash ..... A63B 21/0058 482/99
5,476,428 A 12/1995 Potash et al.
(Continued)

FOREIGN PATENT DOCUMENTS

EP 3597275 A1 * 1/2020 ..... A63B 21/018
EP 4194059 A1 6/2023
(Continued)

OTHER PUBLICATIONS

Communication Pursuant to Article 94(3) EPC dated Jun. 25, 2025 pertaining to EP application No. 24 201 874.5, pp. 1-9.

*Primary Examiner* — Gary D Urbiel Goldner
(74) *Attorney, Agent, or Firm* — Dinsmore & Shohl LLP

(57) ABSTRACT

The application relates to a hybrid resistance generation system for exercise machines, combining a traditional weight stack with an electromechanical resistance module. The system includes a housing, preferably with separate chambers for each component, ensuring minimized interference. Physical and electromechanical resistance sources are connected in series, offering dynamic resistance adjustments during workouts. A sensor system tracks the resistance applied and movement of the weight stack, providing real-time feedback. The system is adaptable to various exercise machines and offers enhanced user interaction through integrated data processing, enabling seamless transitions between resistance modes and customized training programs.

17 Claims, 10 Drawing Sheets

(56) References Cited

U.S. PATENT DOCUMENTS

| | | | | |
|---|---|---|---|---|
| 7,163,488 | B2 * | 1/2007 | Anders | A63B 21/0724 482/4 |
| 10,456,614 | B1 * | 10/2019 | Dube | A63B 24/0062 |
| 10,814,172 | B1 * | 10/2020 | Ilfrey | A63B 23/035 |
| 11,883,717 | B2 | 1/2024 | Claudio et al. | |
| 2014/0228174 | A1 | 8/2014 | Olsen | |
| 2017/0197103 | A1 * | 7/2017 | Rau | A63B 21/0057 |
| 2018/0099184 | A1 * | 4/2018 | Eder | A63B 21/154 |
| 2020/0254309 | A1 * | 8/2020 | Watterson | A63B 21/075 |
| 2021/0260445 | A1 * | 8/2021 | Knestel | A63B 21/078 |
| 2022/0134171 | A1 * | 5/2022 | LoDuca | A63B 21/063 482/99 |
| 2023/0241448 | A1 * | 8/2023 | LoDuca | A63B 21/4035 482/99 |
| 2025/0360350 | A1 * | 11/2025 | Lukanov | A63B 21/0628 |
| 2026/0007921 | A1 * | 1/2026 | Lukanov | A63B 21/4045 |
| 2026/0027401 | A1 * | 1/2026 | Lukanov | A63B 21/00065 |

FOREIGN PATENT DOCUMENTS

| | | | | |
|---|---|---|---|---|
| KR | 101861240 | B1 * | 5/2018 | A63B 71/0622 |
| WO | 2009107904 | A1 | 9/2009 | |
| WO | 2023229601 | A1 | 11/2023 | |

* cited by examiner

HYBRID RESISTANCE GENERATION SYSTEM FOR AN EXERCISE MACHINE

The present application generally relates to a hybrid resistance generation system for an exercise machine. The hybrid resistance generation system comprises a housing, a sensor system, a weight stack with a plurality of weights that can be coupled with a weight sword providing a first resistance source, and an electromechanical resistance module providing a second resistance source. The first resistance source and the second resistance source are connected in series, so that a resulting resistance source is applied to a first cable, which is preferably coupled to the weight sword.

BACKGROUND

In general, an exercise machine is a mechanical device designed to support and optimize physical exercises. These machines are commonly used in gyms, rehabilitation centers, and can also be used in private homes to train various muscle groups, improve physical fitness, and achieve specific health goals. There are different types of exercise machines, such as cardio machines that enhances cardiovascular fitness, strength machines that increases muscle strength and mass, and flexibility and stretching machines that improves body flexibility and mobility. Multifunctional machines combine various functions to provide comprehensive training.

Fitness strength machines with weight stacks, also known as selectorized machines, are a common type of exercise machines. These machines typically feature weight stacks ranging from 45 kg to 200 kg, often segmented into 5 kg or 10-pound increments. The weight blocks, often referred to as "Iron Weights", are connected to a system of cables and pulleys, providing the necessary resistance for a variety of cable-based exercises. These machines are the industry standard in both commercial and home gym environments.

Exercise machines can be configured as, for example, a power rack, a cable crossover machine, a functional trainer, a smith machine or a strength and smith machine.

Examples of exercises that can be performed on selectorized machines include lat-pulldowns, chest flyes, seated rowing, shoulder presses, and leg curls. Users can adjust the weight resistance by moving a pin between different weight blocks, coupling the selected weight blocks to a weight sword, which allows for customization of the workout intensity.

However, this adjustment process can be inconvenient as each adjustment requires the user to interrupt the exercise and move away from the training position to change the weight by moving the pin. In addition, conventional machines are not equipped with sensors that focus on analyzing and recording combined weights moved by the first and second resistance sources.

There are already solutions of exercise machines on the market that use electrical motors, flywheels, or magnetic brake systems to provide resistance instead of physical iron weights. These solutions rely on one (non-iron weight) resistance source to provide variable resistance to the user.

However, a disadvantage of these electromechanical resistance systems is, by fully cancelling the iron weights, the loss of haptic feedback that users experience with traditional physical weights. When moving physical weights, users feel the inertia, mass, and gravity of the weights, which enhances neuromuscular coordination as they control the weight throughout the exercise. Additionally, there is a psychological and motivational effect associated with visually moving physical weights. Experience shows that it is more positive for an athlete's motivation to move real weights.

US20200254309 A1 and U.S. Pat. No. 7,163,488 B2 each relate to an exercise machine comprising a barbell connected to two cables. The two cables are attached to an electromechanical resistance system that can be adjusted to either assist or resist the lifting of the barbell. Accordingly, these exercise machines comprise a hybrid resistance generation system.

Although the two machines disclosed in the documents combine physical weights with an electromechanical resistance system, they are specifically designed for barbell use with free weights. Consequently, the range of exercises that can be performed with this resistance combination is limited.

SUMMARY

The present application presents a hybrid resistance generation system for an exercise machine that offers a diverse range of exercises without limitations to a barbell-based training, enables an easy weight adjustment for different training regimens, and provides realistic haptic feedback.

In a first aspect, the application relates to a hybrid resistance generation system for an exercise machine comprising a housing with preferably at least two chambers, a sensor system, a weight stack with a plurality of weights that can be coupled with a weight sword providing a first resistance source, and an electromechanical resistance module providing a second resistance source. The first resistance source and the second resistance source are connected in series, so that a resulting resistance source is applied to a first cable, which is preferably coupled to the weight sword.

The integration of a weight stack with a plurality of weights and an electromechanical resistance module into a single resistance generation system for an exercise machine offers a versatile workout experience, allowing users to benefit from the tactile feedback of traditional weights as well as the dynamic, software adjustable and precise control of electronic resistance. Physical weights, in particular the weights of a weight stack, offer high haptic feedback, allowing users to feel inertia, mass, and visually see the movement of the weights, which can improve neuromuscular coordination and motivation. In contrast, a fully electrical system would lack this benefit. This invention preserves the tactile and visual feedback of physical weights, while incorporating the advantages of electronic or electromechanical resistance.

The preferred resistance generation system for an exercise machine enables non-linear force distribution throughout an exercise set without adjusting the weight stack. Users can engage with conventional iron weights while the electromechanical resistance module dynamically ads, increases or decreases resistance within a workout set or even within a single repetition. This enables a dynamic muscle tension curve, which is widely recognized by scientists as optimal for developing muscle strength.

In addition, the preferred hybrid resistance generation system for an exercise machine can be used for any conventional exercise typically performed with traditional weights. This includes, but is not limited to, the bench press, squat, and deadlift (the three main powerlifting movements), as well as the incline bench press, shoulder press, bent-over row, and lat-pulldown. The preferred hybrid resistance generation system is also suitable for an exercise machine which is adaptable to various forms and shapes of strength machines. The primary differences lie in the position of the hybrid resistance generation system within the exercise machine, and the cable routings. However, the main principle of combining simultaneously physical weights and an electromechanical resistance module into a hybrid system remains consistent across different machines.

Generally, a weight stack is preferably a series of rectangular weight plates, usually made of metal, that are stacked and can be selected (in blocks) for use by inserting a pin into the desired weight level. The user can adjust the number of weights by moving the pin to a different weight plate, coupling the selected weight plates to a weight sword. The individual weight plates have a through hole through which the pin can be guided to engage the weight sword. The selected weight plates (or blocks) are preferably guided up and down by a pair of vertical rods and the weight sword, which is connected to a cable and positioned between the vertical rods.

Furthermore, the weight sword may comprise a shaft with axially spaced openings and a plate with through holes which can guide the vertical rods of the exercise machine. The weight sword's design, featuring a shaft with axially spaced openings, allows for easy adjustment of the weight selection. The axially spaced openings are designed to accommodate a pin that couples the selected weights of the weight stack to the weight sword. The weight sword's plate with through holes that guide the rod tubes ensures smooth operation, as the weight sword is always properly aligned and can effectively engage with the weight stack, leading to a stable and secure lifting.

Additionally, a cable refers in the application to a strong, flexible wire or rope used to transmit force and provide resistance during workouts. These cables are typically made of durable materials like steel or high-tensile synthetic fibres. They are designed to withstand significant tension while connecting various components of exercise equipment or hybrid resistance generation systems, allowing for smooth and controlled movement.

As the hybrid resistance generation system comprises a physical and an electromechanical resistance source, it refers to a hybrid system. In addition, since the hybrid resistance generation system may include a housing with at least two chambers, it can alternatively be described as a chamber system. This chamber system is particularly characterized by its ability to connect the resistance sources (physical and electromechanical) in series and place the individual components in separate chambers.

Since the resistance sources are connected in series, a (total) resulting resistance source is generated, which is achieved by the sum of both resistances. Each of these resistances can be individually adjusted.

By placing individual components of the hybrid resistance generation system in separate chambers, the system allows for the physical separation of components. Depending on the components, this can prevent electromagnetic interference or thermal cross-talk or interactions between these components, thereby improving the overall performance of the system. Accommodating each component in a separate chamber also allows for targeted maintenance or replacement of individual components without disturbing the others, thus improving serviceability or mechanically restricting the user access to the chamber with the electrical motor due to safety reasons. The chambered design can be tailored to the specific needs of each component, such as optimized airflow for cooling the electromechanical resistance module, ensuring that each component operates within its ideal environmental conditions.

The housing of the hybrid resistance generation system may comprise at least two chambers. These chambers may be individually tailored to the components of the hybrid resistance generating system as described above. For example, the chambers may be of different sizes and shapes. However, the housing need not consist solely of chambers; it may also include solid portions, for example to ensure that the housing has sufficient weight and remains stable. The housing is preferably made of metal, such as steel, stainless steel or aluminium, fibre reinforced plastic, or plastic.

Additionally, the housing may have openings that, for example, make the components enclosed by the housing visible. For instance, the weight stack may be visible through the openings so that a user can observe the movement of the individual weights. Some openings may also be closable by doors, allowing components to be replaced, serviced or repaired without having to remove the entire housing.

Preferably, a chamber is designed to be separated from other chambers by a partition or wall, which can either be integrated into the structure of the housing or added as a separate component. This partition ensures that each chamber forms a fully enclosed space, protecting the components inside from external influences. The chambers may differ in temperature, air pressure, or protective measures, depending on the specific needs of the housed components.

Additionally, the chamber's shape can vary according to the specific requirements of the components, and it may be equipped with seals to prevent the intrusion of foreign substances.

In a preferred embodiment, a second cable interconnects the electromechanical resistance module and the weight sword. This configuration connects the electromechanical resistance module as a second resistance source in series with the weight stack as a first resistance source.

In this context, the weight stack, in particular the weight sword, is coupled with a first cable, and when this cable is pulled, it generates resistance through the weight stack's gravitational force. The resistance can be increased by adding more weight plates to the weight sword. As tension is applied to the first cable, it exerts a pulling force on the second cable, which is connected to the weight sword. The second cable, in turn, opposes the force applied by the electromechanical module. Consequently, a user pulling on the first cable via the weight stack will also pull on the second cable connected to the electromechanical module, effectively engaging both resistance sources in series.

By having the second cable continuously attached to the weight sword, the electromechanical resistance module remains in an "always on" mode. This means that the electromechanical resistance module is preferably always supplied with power and remain continuously activated to retract the second cable after it has been extended, even when the electromechanical resistance module is not applying any resistance during an exercise. The hybrid resistance generation system is preferably specifically designed so that both cables can always be pulled in series by the user. If the user chooses mode of pulling only physical weight, i.e. the weights of the weight stack, the electromechanical module provides almost zero resistance, just enough to pull the second cable in.

In this regard, there is no need for the user to switch between resistance sources manually. The user can start a workout with physical weights, i.e. the weight stack, and switch to a hybrid resistance workout by using a simple voice command or by pressing a control element, preferably by using just one finger, such as a button or rotating adjustment rings on the user interface. The electromechanical resistance module is preferably always connected to grid power for on-demand power and can be connected to the user's smartphone via Bluetooth or Wi-Fi.

To ensure continuous operation, a power source is provided to supply voltage to the electromechanical resistance module. This can be achieved through various means. The proposed hybrid generation system or the electromechanical resistance module may include a battery and/or a solar panel, or may have a connection that allows it to be plugged into the power grid.

The inclusion of a second cable as a connection between the weight stack (as the first resistance source) and the electromechanical resistance module (as the second resistance source) creates a stable connection that allows for direct and immediate force transmission. The system is also flexible, allowing the weight stack and the electromechanical resistance module to be positioned relative to each other as needed, with pulleys used to guide the cables within the housing.

Preferably, the hybrid resistance generation system comprises at least one pulley which guides the second cable to the weight sword of the weight stack. This design results in a smooth coupling between the weight sword and the electromechanical resistance module. Additionally, the pulley helps to manage the load on the second cable, which contributes to increased durability and a longer lifespan for the system. Preferably, the pulley is attached to the housing or a frame of the housing.

A pulley is preferably a wheel mounted on an axle or shaft, designed to facilitate the movement and change the direction of a cable, rope or belt. It features preferably a groove or channel that keeps the cable securely in place. Typically, it includes bearings to ensure smooth operation and is constructed from durable materials such as metal or high-strength plastic. The pulley is usually mounted on robust brackets that attach to a system or machine. Some pulleys have an adjustment mechanism to alter the height or angle, and include safety features such as guards to prevent cable slippage and protect users. The wheel and groove have a smooth finish to minimize wear on the cable, and the entire assembly is preferably rated for a specific load capacity to ensure safe and effective operation.

In a further preferred embodiment, the weight stack is located in a first chamber and the electromechanical resistance module is located in a second chamber. Locating the weight stack and the electromechanical resistance module in separate chambers can reduce interference between the two components. For example, the chamber housing the weight stack can be designed to effectively absorb vibrations, preventing any impact on the electromechanical resistance module and its sensitive electronics.

Further, the division of chambers can be tailored to meet the specific requirements of the weight stack or the electromechanical resistance module, resulting in an overall constructive advantage. For instance, the chamber containing the electromechanical resistance module can be cooled independently. This means that only a relatively small chamber needs to be cooled, rather than the entire housing, reducing the cooling power and energy required by the system.

It is apparent that the weight sword may also be housed within the same chamber as the weight stack and can be considered part of it. It is possible for a portion of the weight stack and the weight sword to remain in an initial position within the chamber. However, when the weight sword is pulled out, it may leave the chamber, along with the weight plates of the weight stack that are connected to the weight sword.

Preferably, an electromechanical resistance module refers to a device that provides adjustable resistance during workouts using electrical and mechanical components. This module can precisely control the level of resistance through electronic means, offering dynamic and customizable workout experiences. Examples include motorized systems or flywheels that use electromagnetic braking to adjust resistance.

The electromechanical resistance module may comprise an electric motor with a winch on which the second cable can be wound and unwound. The integration of an electric motor with a winch for winding and unwinding the second cable enhances the precision and reliability of the resistance adjustments, allowing for smooth transitions and consistent resistance levels during operation. The use of an electric motor provides the advantage of automated control over the resistance levels, which can be programmatically adjusted to suit various exercise regimes, thereby offering a tailored workout experience to the user. The winch mechanism allows for compact storage of the second cable when not in use. The electric motor can preferably be a servo motor, a DC motor, and/or a brushless DC motor, ensuring high accuracy and control over the cable movements, allowing for precise adjustments and maintaining consistent tension throughout the exercise.

Particularly preferred is the use of a brushless outrunner motor for the electromechanical resistance module. This motor has the advantage of operating without a gearbox, simplifying the design of the electromechanical resistance module and making it particularly efficient. In this configuration, the electric motor can be directly connected to the winch.

Alternatively, other embodiments are also possible, where a gearbox may be interposed between the electric motor and the winch, providing additional mechanical advantage and control over the cable movements.

Moreover, the electromechanical resistance module can, for example, comprise an electric servo motor, each with a power range between 500 W and 1000 W, along with a servo driver, a controller board, ground connection cables, and Bluetooth communication chips. Other configurations are also possible, where an electric servo motor with a power range of 50 W to 4000 W is used, or within a range of 250 W to 1200 W. The servo motors are not limited to these ranges.

In a further preferred embodiment, the weight stack is located in a first chamber and the electric motor is located in a second chamber and the winch is located in a third chamber. This allows for easier maintenance and repair, as each component can be accessed individually without disturbing the others.

The second chamber and/or the third chamber can be located below the first chamber. In this way, the weight sword can be positioned above the winch, enabling the second cable to be routed from below to the lower end of the weight sword, thus facilitating a simple and direct coupling between the winch and the weight sword. It will be apparent to those skilled in the art that an opening may be provided in the ground or floor of the first chamber through which the second cable and/or the weight sword can pass to reach the lower third chamber.

Further, the electromechanical resistance module may comprise a control unit with a data processing unit for controlling the second resistance source and a communication unit for data communication. The inclusion of a control unit with a data processing unit, especially in combination with sensor measuring conventional iron-weights moved and electrical resistance provided, enables the hybrid resistance generation system to offer dynamic resistance adjustments based on real-time feedback. This can enhance the effectiveness of workouts by automatically adapting resistance to the user's performance. The communication unit allows for data exchange with external devices or networks, providing opportunities for remote monitoring, software updates, and integration with fitness tracking systems. The control unit's ability to manage the second resistance source, in particular the electromechanical resistance module, ensures a seamless and user-friendly experience, as it can automatically calibrate resistance levels in response to programmed workout routines or user preferences.

In a further preferred embodiment, the hybrid resistance generation system may comprise a sensor system configured to acquire the resistance of the first resistance source and/or the second resistance source and/or the resulting resistance source and/or the movement of the weight stack and/or weight sword and/or the movement of the first cable.

Preferably the sensor system comprises at least one sensor, a battery and a communication unit. Furthermore, the sensor system can comprise a data processing unit, a memory and/or a housing which accommodates all components.

The sensor system provides real-time feedback and enhanced precision, ensuring consistent resistance for effective workouts. It enables personalized workout programs tailored to individual needs and goals, while also improving safety by monitoring force and movement to prevent injuries. Users can track their progress and performance, and the control unit of the electromechanical resistance module can automate adjustments for an optimized exercise experience. This system increases engagement and motivation through real-time data, making workouts more efficient and integrating seamlessly with fitness apps for comprehensive tracking and goal setting.

For example, the signals or acquired data from the sensor system can be combined, analyzed, cloud-stored and displayed to the user through a software application running on an external device such as a smartphone or tablet. The software application can also be configured to control the main settings of the electromechanical resistance module, including setting the resistance, switching between kg/lbs settings and providing the user with pre-defined exercise programs.

Preferably, the electromechanical resistance module and/or the sensor system and/or the user interface of the exercise machine may be in data communication with an external device having a data processing unit and a communication unit. The sensor system may comprise means for providing acquired data to the external device. The user interface may comprise means for providing an input signal to the external device.

In a further preferred embodiment, the sensor system may comprise a laser device. The laser device can be positioned either below the lowermost weight plate of the weight stack or above the plate of the weight sword and is directed to a pin of the weight stack. Preferably, the laser device is configured to emit one laser beam towards the pin and, by analyzing the reflection of the laser beam, calculating distance moved and repetitions completed on the weight stack. This information can be important to the functionality of the hybrid weight system, since it can automatically and dynamically adjust the electrical motor resistance based on the information how much physical weight the user has selected and the users performance during a particular exercise.

Preferably, the laser device is a distance, range, or proximity measuring device. It specifically measures the distance between the laser emission point on the laser device and the pin of the weight stack when the laser device is directed to the pin. The pin preferably has a highly reflective surface, ensuring that the reflections return to the laser device without interference. The laser device is preferably equipped with a sensor, such as a photodiode, to analyze the reflected beams effectively.

The laser device can be aligned so that it is positioned in a distance centrally either below or above the pin. The pin comprises preferably a shaft and a pin head. The laser beam is particularly directed at the pin head, while the pin shaft is inserted into the weight stack and couples the individual weight plates or weight blocks to the weight sword. The laser beam preferably radiates or is directed in a substantially vertical direction onto the pin head, either from below or from above. Each plate of the weight stack has a predefined distance from the laser device, allowing the laser device to detect which weight plates are coupled with the weight sword and how much weight the user is lifting. Additionally, the laser device can detect the progress of a repetition and the completion of the repetition by monitoring the continuous changes in distance.

It is apparent for the skilled person that the laser device may have its own control unit, equipped with a data processing unit, a memory, and/or communication unit, which can be in data communication with the control unit of the electromechanical resistance module or an external device.

In an alternative embodiment, the sensor system comprises a load cell, a three-axis accelerometer, a battery, a communication unit, and/or a data processing unit, wherein the load cell interconnects the first cable which is coupled to a user interface of the exercise machine with the weight sword of the weight stack. In particular, the load cell may be connected to an end of the first cable and directly fixed to the weight sword.

In this regard, the load cell converts force into an electrical signal by measuring weight through the deformation or strain in a material when a load is applied. It is preferably connected to the top of a weight sword. The three-axis accelerometer, which can be attached to the back of the load cell, measures acceleration and the distance a weight is moved along three perpendicular axes (X, Y, and Z). Such three-axis accelerometer are for example commonly used in smartphones to detect movement and direction. The rechargeable battery can also be located on the back of the load cell and powers the sensor system.

Moreover, an external device may be configured to process the provided data of the sensor system and/or the provided input data of a user interface and/or to transmit control commands to the electromechanical resistance module. The integration of an electromechanical resistance module and a sensor system in data communication with an external device enhances the interactivity and personalization of the workout experience, as it allows for real-time tracking and adjustment of exercise parameters based on user performance. The ability of the external device to process sensor data and user inputs, and to transmit control commands to the electromechanical resistance module, enables the implementation of advanced training programs and routines that can dynamically adapt to the user's needs and progress.

The external device can be a smartphone, tablet, smartwatch, computer, or any other device with data processing and communication capabilities (without being limited to these options).

The system's design facilitates seamless integration with existing technology ecosystems, such as smartphones or computers, allowing users to leverage their devices for additional functionalities like workout logging, social sharing, or accessing a broader range of digital fitness services.

In a further preferred embodiment, the hybrid resistance generation system may comprise at least one display which can display data processed by the control unit of the electromechanically resistance module and/or a control unit of the sensor system. The display can be designed as a LCD display and located on the side wall or front face of the housing of the hybrid resistance generation system so that the LCD display is visible for the user during exercise. The display can display data processed by the control unit of the sensor system, the external device or the electromechanical resistance module, such as weight measurements in KG or LBS, offering users real-time feedback and interaction with the hybrid resistance generation system. The display can also be a smartphone, which is magnetically attached to the housing and wirelessly charged with a wireless charger holder.

In a further aspect, the application relates to an exercise machine. The exercise machine comprises a body, a hybrid resistance generation system according to any of the embodiments above, and at least one pulley which is attached to the body guiding the first cable to a user interface for applying a force against the resulting resistance source, wherein the user interface is attached to the first cable.

In a preferred embodiment, the exercise machine is designed as a power rack attachment, a stand-alone tower, a squat rack, a half rack, a power rack or a strength and smith machine. The design of the present exercise machine allows for easy integration in both home gyms and professional fitness centers, the utility of the space and investment by serving multiple purposes and supporting a wide range of exercises.

A power rack is preferably a large, cage-like structure with four vertical posts and horizontal bars at the top and bottom. It typically includes adjustable hooks and safety bars that can be moved to various heights. This equipment is highly versatile, allowing for a wide range of exercises beyond squats, such as bench presses, overhead presses, and deadlifts. Power racks are available in multiple sizes and variations, including half racks, wall racks, foldable racks, each preferably with four or more posts.

A squat rack is preferably a simple form of a power rack. It comprises of two vertical posts or a single connected unit that supports a barbell at a fixed or adjustable height. Squat racks may also have lat-pulldowns or smith machines attached to them.

Preferably, a strength machine is an exercise machine designed to assist users in performing resistance training exercises. These machines typically utilize weight stacks, hydraulic resistance, or other mechanisms to provide adjustable resistance. Strength machines guide the user's movements along a fixed path, which can help ensure proper form and reduce the risk of injury. They are commonly used in gyms, fitness centers, and home workout setups.

A smith machine is preferably a weight training apparatus integrated into a strength machine or power rack, consisting of a barbell fixed within steel rails, allowing it to move vertically in a guided path. It is preferably designed for performing movements like squats, bench presses, and shoulder presses. The barbell can be locked at various heights using safety catches.

A power tower is preferably a fitness equipment designed for bodyweight exercises that target the upper body and core. It typically includes stations for pull-ups, chin-ups, dips, push-ups, and vertical knee raises. The power tower's structure consists preferably of a free-standing frame with padded grips and back supports to facilitate these exercises.

In general, the user interface of the exercise machine allows a user to exert force against a resistance in order to exercise muscles. The user interface may take a variety of forms, including (but not limited to) a single handle, a long bar handle, a lat pull-down handle, a rope, etc.

Additionally, embodiments are also possible in which the user interface may comprise means for providing an input signal to the control unit of the electromechanical resistance module. The user interface's provision for input signals to the control unit allows users to easily customize their workout experience by selecting desired resistance levels, exercise durations, and other parameters, thereby improving user satisfaction and workout personalization. The means for providing input signals can include various user-friendly options such as buttons, rotational adjustment rings, touchscreens, or microphones for voice commands, which can enhance accessibility. By enabling direct user interaction with the control unit of the electromechanical resistance module, the user interface facilitates immediate adjustments to the workout, allowing users to quickly respond to their own comfort and performance levels, which can lead to more effective and enjoyable exercise sessions. The user interface preferably comprises a communication unit and a rechargeable battery which allows to transmit the input signals to the electromechanical resistance module. It can also comprise a memory or a data processing unit.

Preferably, the user interface is designed as a handle featuring a rotational adjustment ring and a haptic button that allows the user to increase, decrease, or stop the electromechanical resistance. Operated with only one finger, this technology can be seen as a One-Thumb control. Different sizes and shapes of handles are preferably available depending on the exercise.

The user can start their training using only physical weights and activate the electromechanical resistance from the electromechanical resistance module with a simple thumb rotation on the handle. The handle can be battery-powered, and the battery can be charged with a USB-C cable by plugging it directly into the electromechanical resistance module. The signal from the handle may be transferred wirelessly to the electromechanical resistance module.

In a further aspect the application relates to a method for adjusting a force to be applied by a user to the exercise machine according to the embodiment above.

The method can comprise the steps of applying a force against the resulting resistance source by the user interface, and/or of acquiring the movement of weights of the weight stack, in particular a speed and/or an acceleration of the movement by the sensor system, and/or of providing the acquired data of the sensor system to the control unit of the electromechanical resistance module, and/or of detecting by the control unit of a decrease in the speed and/or acceleration in relation to previously acquired data by the sensor system, and of adjusting the second resistance source by the control unit of the electromechanical resistance module.

This method can automatically respond to the user's condition using the captured sensor data and adjust the resistance of the electromechanical resistance module accordingly. For example, when the sensor system detects that the user is getting tired, indicated by slowing repetitions, it will decrease the electromechanical resistance. This enables the user to continue the workout without having to stop due to high weights or fatigue, a feature not possible with conventional exercise machine comprising iron weights.

Alternatively, the method can comprise the steps of applying a force against the resulting resistance source by the user interface, or of providing an input signal to the control unit by the user interface, and of adjusting the second resistance source by the control unit of the electromechanical resistance module. The ability to adjust resistance through user input during a workout by moving only one thumb provides high flexibility in the exercise regimen, allowing users to quickly switch between different training modes, such as warm-up, endurance or strength, without interrupting the users workout flow.

In another alternative the method can comprise the steps of providing an input signal to the control unit of the electromechanical resistance module which sets the control unit in an automatic training mode, of applying a force against the resulting resistance source by the user interface, causing the weights of the weight stack to be lifted, of reducing the force against the resulting resistance source causing the weights of the weight stack to be lowered, and of adjusting the second resistance source by the control unit.

The automatic training mode simplifies the user experience by allowing the exercise machine to adjust resistance levels autonomously based on predetermined algorithms, which can optimize workouts for efficiency and effectiveness without constant user interaction. The input signal may be provided by a user interface or an external device.

In another alternative the user may use the electromechanical resistance module to fine tune the physical weight, such as conventional iron weights. As an example, a user may choose 40 kg iron weights as a training weight and add an electrical resistance equivalent of 2 kg to arrive at a total weight of 42 kg, dominated by the haptic feedback of the iron weights and barely noticeable electrical resistance. This fine-tuning to 42 kg would not be possible with a conventional strength machine, since iron blocks are typically in 5 kg or 10 lbs blocks. This fine tuning is especially important to break so-called plateaus, where users need a gradual, incremental increase in small weights between 1 kg and 2 kg to reach new performance levels.

The skilled person will recognize that the advantages, technical effects and preferred embodiments discussed in connection with the hybrid resistance generation system and the exercise machine apply analogously to the method for adjusting a force to be applied by a user to the exercise machine. Likewise, all the advantages, technical effects and preferred embodiments described in connection with the method are transferable to the hybrid resistance generation system and the exercise machine.

Further examples of embodiments are explained in more detail below with reference to the accompanying drawings. The invention is not intended to be limited solely to these listed examples of embodiments. They merely serve to explain the invention in more detail. The present invention is intended to relate to all objects which the person skilled in the art would use now and, in the future, as obvious to realize the invention.

DETAILED DESCRIPTION

Some parts of the embodiments have similar or identical parts. The similar or identical parts may have the same names and/or reference number. The description of one part applies by reference to another similar part, where appropriate, thereby reducing repetition of text without limiting the disclosure.

Figure 1:
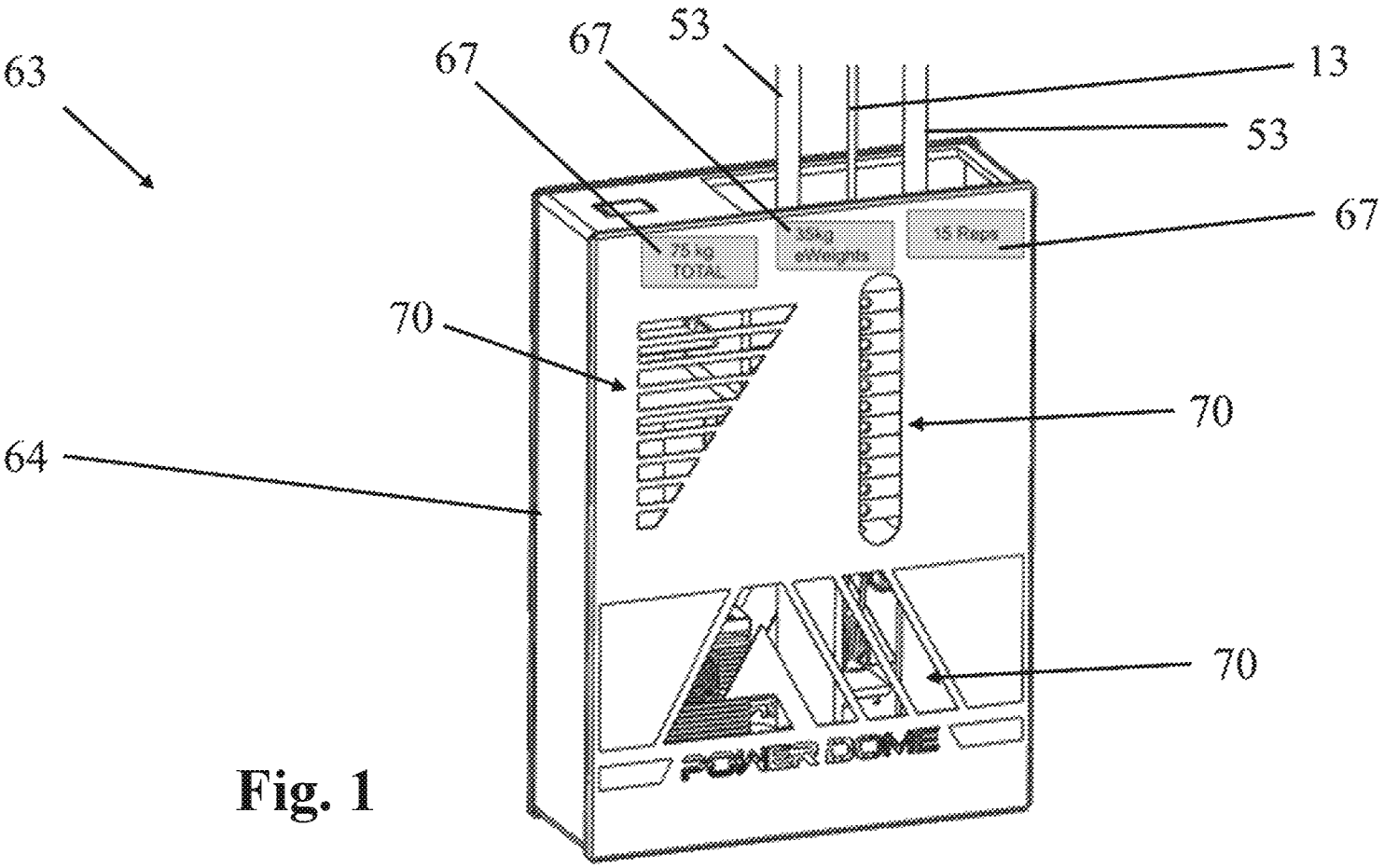
FIG. 1 shows a preferred embodiment of the hybrid resistance generation system in a perspective view.

FIG. 1 shows a preferred embodiment of the hybrid resistance generation system 63 in a perspective view. The hybrid resistance generating system 63 is preferably intended for use in an exercise machine 1.

The hybrid resistance generation system 63 comprises a sensor system 35, a weight stack 5, and an electromechanical resistance module 7. All of the components of the hybrid resistance generation system 63 are enclosed in a housing 64.

The hybrid resistance generation system 63 is preferably incorporated into an exercise machine 1 in such a way that the weight stack 5 is positioned between two rod tubes 53 of the exercise machine 1, so that individual weight plates of the weight stack 5 can be guided vertically when being lifted by a first cable 13. A user interface may be attached to the first cable 13 so that a force can be applied to the first cable 13 by a user. The housing 64 has an opening on the upper side, through which the two rod tubes 53 of the exercise machine 1 are inserted into the housing 64 so that the rod tubes 53 of the exercise machine 1 can interact with the weight stack 5.

The housing 64 has openings 70 which are provided, for example, for observing the individual components, such as the movement of the weight plates of the weight stack 5, during exercises. In addition, the openings 70 may be provided to provide an air inlet for cooling the electromechanical resistance module 7.

Moreover, the hybrid resistance generation system 63 can also include a display 67. The display may be an LCD display and is preferably located on the side wall or front of the housing 64 so that the LCD display is visible to the user during exercise. The display 67 can display data processed by the control unit of the sensor system 35, an external device or the electromechanical resistance module 7, such as weight measurements in KG or LBS of the weight stack 5, resistance measurements of the electromechanical resistance module 7 or the number of repetitions that a user has performed during an exercise.

Figure 2:
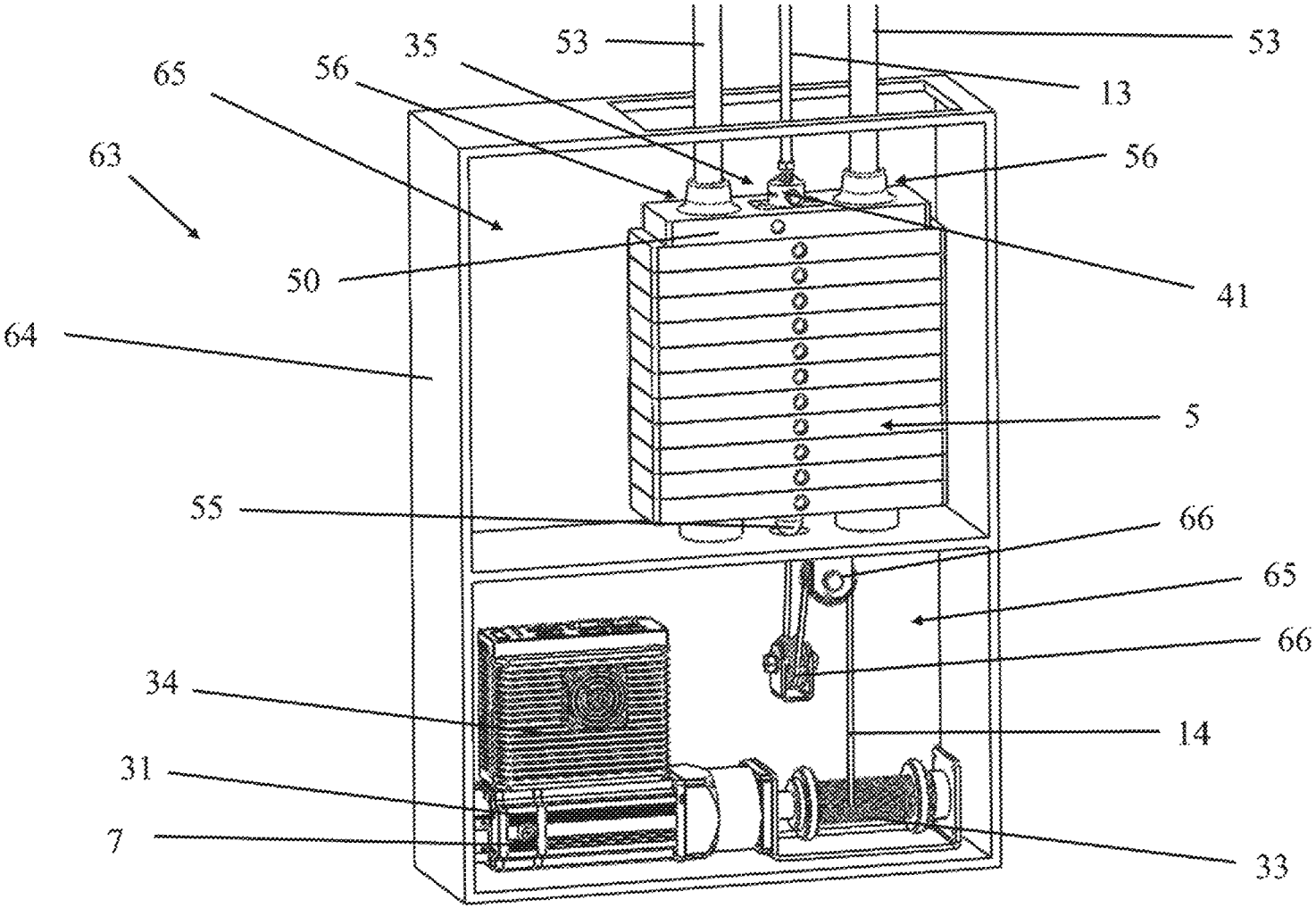
FIG. 2 shows a cross section of a preferred embodiment of the hybrid resistance generation system with two chambers.

FIG. 2 shows a cross section of a preferred embodiment of the hybrid resistance generation system 63 with two chambers 65. In this figure, the front side of housing 64 has been virtually removed so that the inside of housing 64 can be seen.

The weight stack 5 comprises a plurality of weights that can be coupled with a weight sword 43. The weight stack 5 provides a first resistance source, while the electromechanical resistance module 7 provides a second resistance source. Both resistance sources are connected in series, so that a resulting resistance source is applied to a first cable 13.

The first cable 13 is coupled to the weight sword 43, in particular to a plate 50 of the weight sword 43. The plate 50 of the weight sword 43 as well as all weight plates of the weight stack 5 have through holes 56 to guide the rod tubes 53 of the exercise machine 1.

Furthermore, the weight sword 43 also has a shaft 55 with axially spaced openings, which is connected to a second cable 14 at the end of the shaft 55. The shaft 55 serves, in particular, to couple the weight of the weight stack 5 to the weight sword 43 via the axially spaced openings by means of a pin 18 (not shown in FIG. 1, 2 or 3).

The second cable 14 is used to connect the electromechanical resistance module 7 and the weight sword 43, so that the resistance generated by the weight stack 5 is connected in series with the resistance generated by the electromechanical resistance module 7.

In this regard, the weight stack 5 is located in a first chamber 65 and the electromechanical resistance module 7 is located in a second chamber 65, wherein the second chamber 65 is located below the first chamber 65. Two pulleys 66 guide the second cable 14 to the weight sword 43 of the weight stack 5.

The electromechanical resistance module 7 comprises an electric motor 31 with a winch 33 on which the second cable 14 can be wound and unwound.

In addition, the sensor system 35 comprises a load cell 41. The load cell 41 is mounted directly on the plate 50 of the weight sword 43. The load cell 41 is connected to the end of a cable 13 which can be coupled to a user interface, such as a handle, of an exercise machine 1. The load cell 41 may be connected to the plate 50 of the weight sword 43 via screw connections, so that the load cell 41 is firmly anchored in the plate 50 and can measure the forces acting between the cable 13 and the plate 50.

Figure 3:
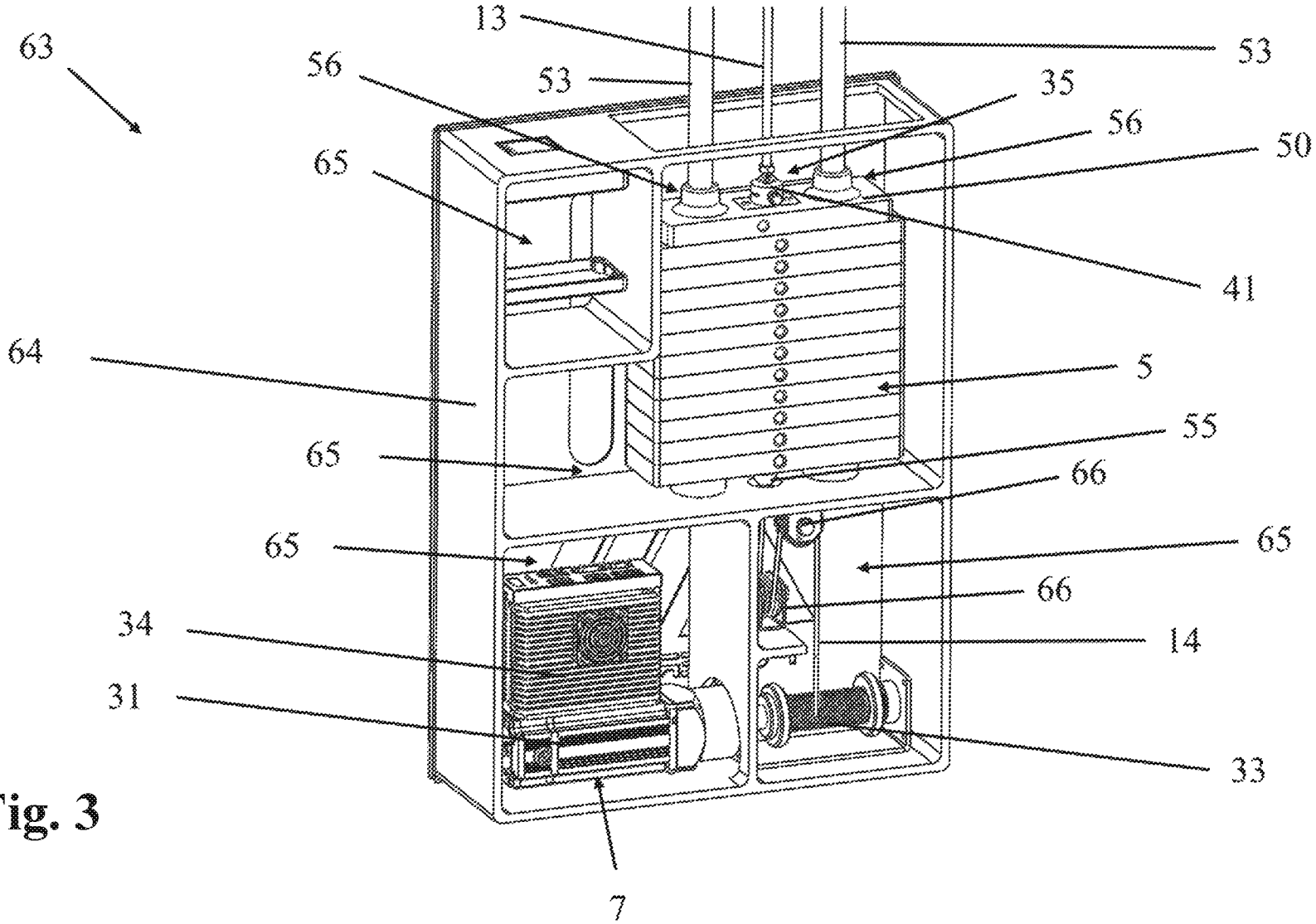
FIG. 3 shows a cross section of a preferred embodiment of the hybrid resistance generation system with four chambers.

FIG. 3 shows a cross section of a preferred embodiment of the hybrid resistance generation system 63 with four chambers. Similar to FIG. 2, the front of the housing 64 is (virtually) removed.

The housing 64 is in this embodiment divided into four chambers 64. In this context, the weight stack 5 is located in a first chamber 65. The components of the electromechanical resistance module 7 are separated into two further chambers 65. Thus, the electric motor 31 of the electromechanical resistance module 7 is located in a second chamber 65, while the winch 33 of the electromechanical resistance module 7 is located in a third chamber 65.

In a fourth chamber 65, upper left in the corner of the housing 64, a holder for a smartphone or the like is provided. The housing 64 can have an opening 70 at the front at the location of the fourth chamber 65, through which the smartphone is visible for a user from the outside when it is inserted in the fourth chamber 65.

Figure 4:
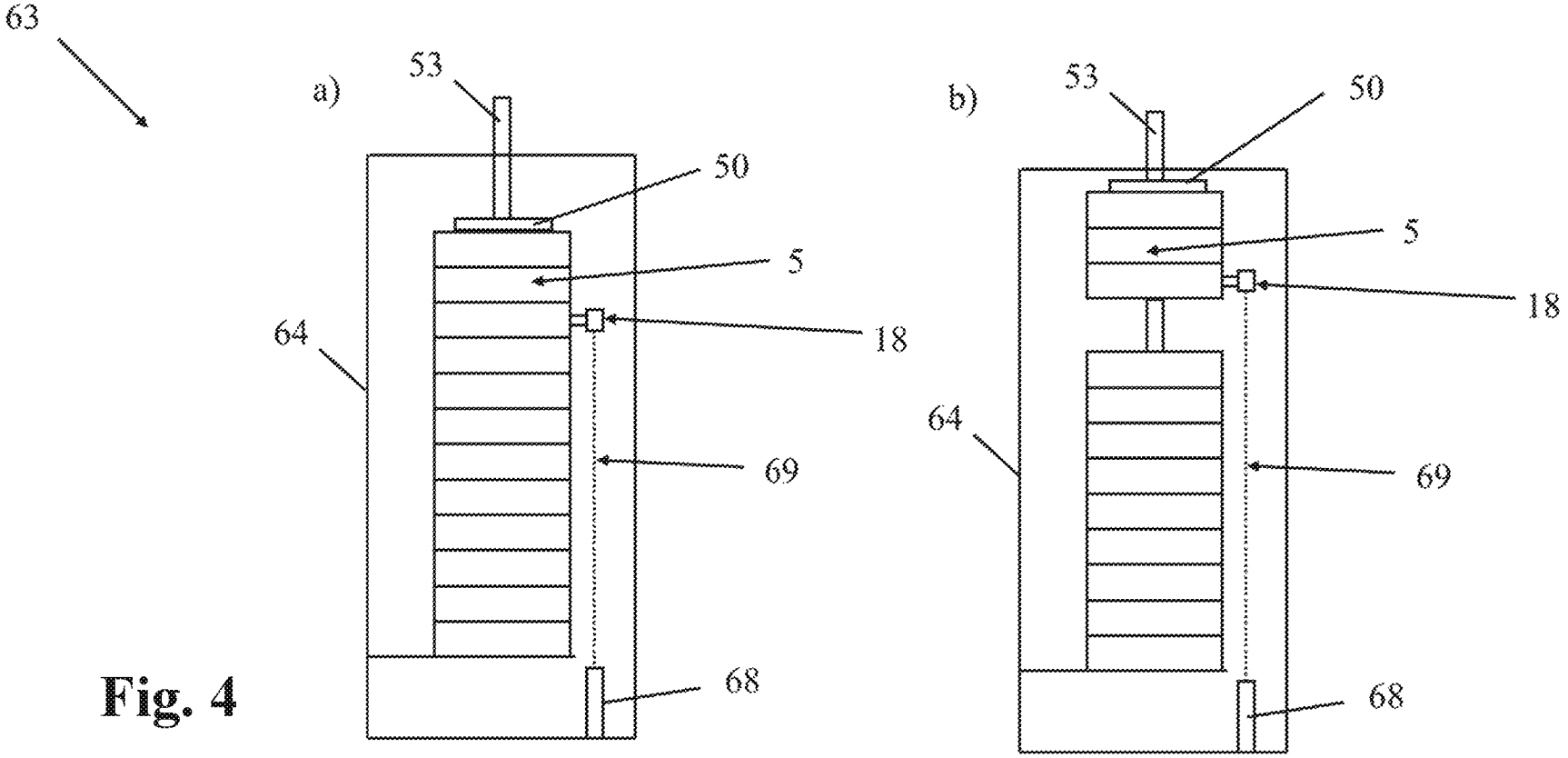
FIG. 4 shows a schematic representation of a preferred embodiment of the hybrid resistance generation system using a laser device as a sensor system.

FIG. 4 shows a further preferred embodiment of the hybrid resistance generation system 63. This embodiment is depicted in a schematic cross-sectional view, showing the hybrid resistance generation system 63 from a lateral perspective.

The hybrid resistance generation system 63 comprises a laser device 68, wherein the laser device 68 is positioned below a lowermost weight plate of the weight stack 5 and is directed to a pin 18 of the weight stack 5. For example, the laser device 68 can be located in a chamber 65 which is located below the chamber 65 of the weight stack 5.

The laser device 68 is configured to emit a laser beam 69 towards the pin 18 and to analyze the reflection of the laser beam 69 on the pin 18. The pin 18 comprises a shaft and a pin head. The laser beam 69 is particularly directed at the pin head, while the pin shaft is inserted into the weight stack 5 and couples the individual weight plates or weight blocks to the weight sword 43.

Each plate of the weight stack 5 has a predefined distance from the laser device 68 in an initial position (a). A control unit controlling the laser device 68 can assign a certain weight to the predefined distances. This makes it possible to determine how many weight plates are lifted.

For example, the third plate from the top of the weight stack 5 is at a distance x from the laser device 68 in an initial position (a). The laser device 68 knows from stored data that the pin 18 is inserted into the third weight plate of the weight stack 5 at the distance x. When it is lifted to a second position (b), three weight plates are lifted to a distance y. Since each weight plate weighs 5 kg and the weight sword 43 weighs 2 kg, the control unit can determine that the user is lifting 17 kg of physical weight.

When the lifted weight plates are returned from position (b) to position (a) or near position (a), the laser device can determine, based on the distance x, that a repetition has been completed. In this way, it can count the repetitions.

It is also hereby disclosed that the laser device 68 can be used with a conventional weight stack 5 independently and without the other components of the hybrid resistance generation system 63.

Figure 5:
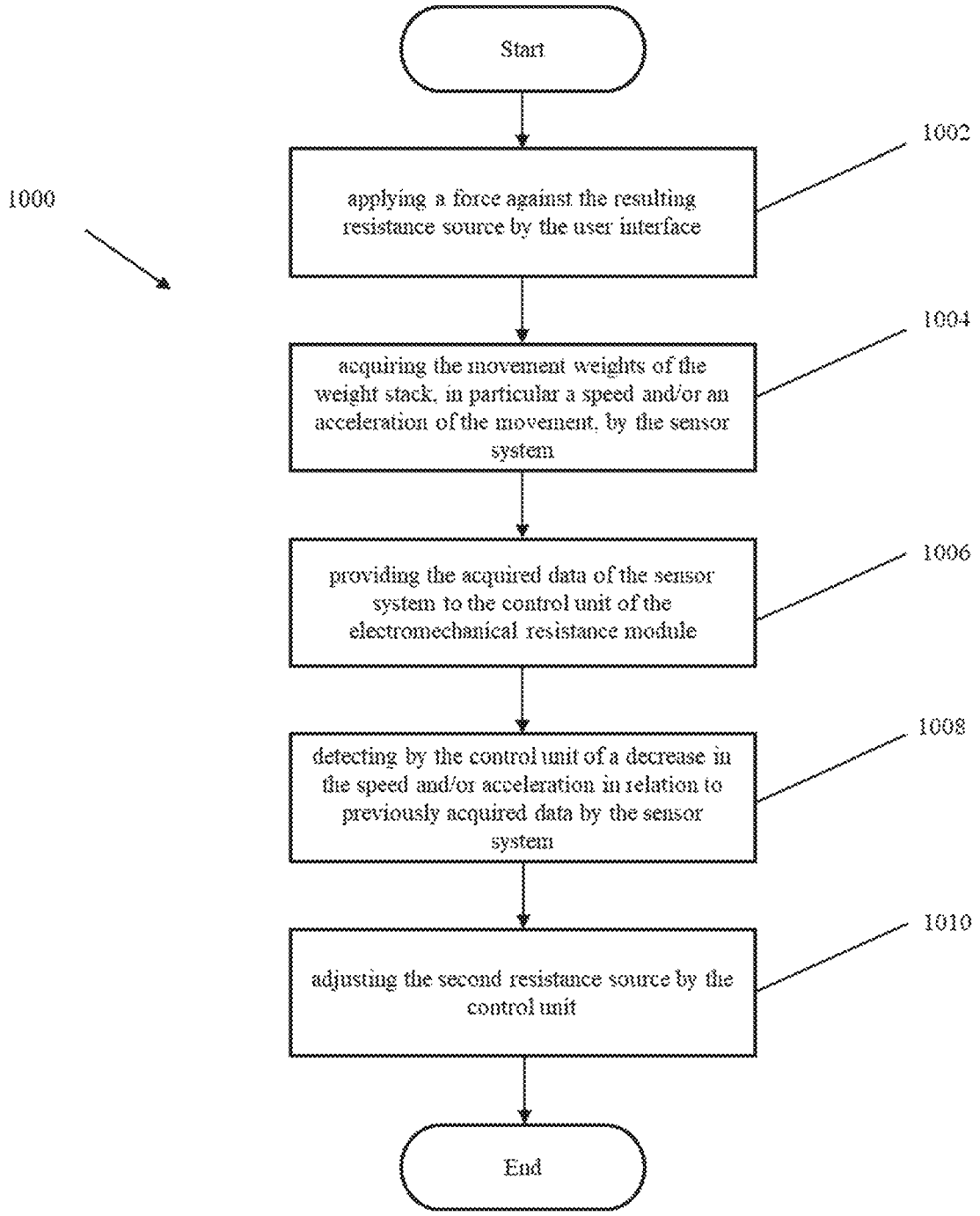
FIG. 5 shows a flowchart outlining a method for adjusting the force applied by a user to a preferred exercise machine.

FIG. 5 is a flowchart illustrating a preferred method 1000 for adjusting the force to be applied by a user to an exercise machine 1. At 1002, method 1000 includes applying a force against the resulting resistance source by the user interface. At 1004, it involves acquiring the movement of the weights of the weight stack 5, in particular the speed and/or acceleration of the movement, by the sensor system 35. At 1006, the method includes providing the acquired data from the sensor system 35 to the control unit 34 of the electromechanical resistance module 7. At 1008, the control unit 34 detects a decrease in speed and/or acceleration in relation to previously acquired data from the sensor system 35. At 1010, the control unit 34 adjusts the second resistance source.

Handling a high number of weights of the weight stack 5 can be risky. By splitting between weights of the weight stack 5 and electromechanical resistance module 7, digital safety measures can be implemented to gradually reduce or completely turn off electromechanical resistance module 7 in case of danger.

When the hybrid resistance generation system 63 detects that the user is getting tired, the sensor system 35 and/or the control unit 34 electromechanical resistance module 7 can notice the repetitions slowing down, by measuring slower three-axis accelerometer movements and longer fatigue breaks, and will decrease the electromechanical resistance.

For example, the user may select 40 kg of weights of the weight stack 5 and an electromechanical resistance equivalent to 20 kg. If the user feels fatigued during an exercise, the sensor system 35 and/or the control unit 34 will detect this by registering a slower push/pull of the weights of the weight stack 5, typically at the end of a set. The electromechanical resistance module 7 will then decrease the electromechanical resistance by 5 kg and subsequently by 1 kg with each subsequent repetition. This enables the user to continue the workout without having to stop due to high weights or fatigue, a feature not possible with conventional physical weights.

Figure 6:
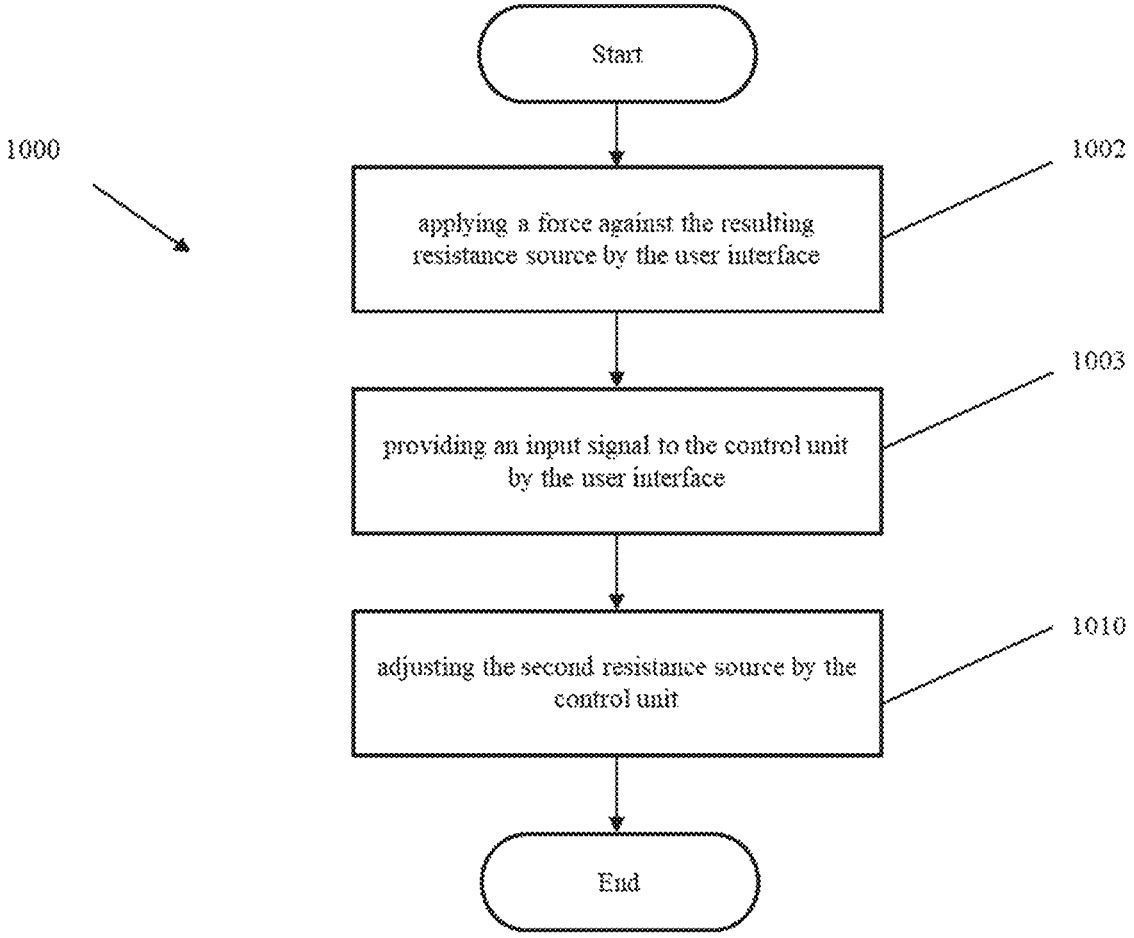
FIG. 6 shows a flowchart outlining another method for adjusting the force applied by a user to a preferred exercise machine.

FIG. 6 shows a flowchart outlining a further preferred method 1000 for adjusting the force applied by a user to a preferred exercise machine 1. At 1002, the method 1000 includes applying a force against the resulting resistance source by the user interface. At 1003, it involves providing an input signal to the control unit 34 by the user interface. At 1010, the method 1000 includes adjusting the second resistance source by the control unit 34. This method 1000 allows the user to manually adjust and/or stop the resistance of the electromechanical resistance module 7 by the user interface. For this purpose, the user interface may include input means such as a rotary adjustment ring or a button.

Figure 7:
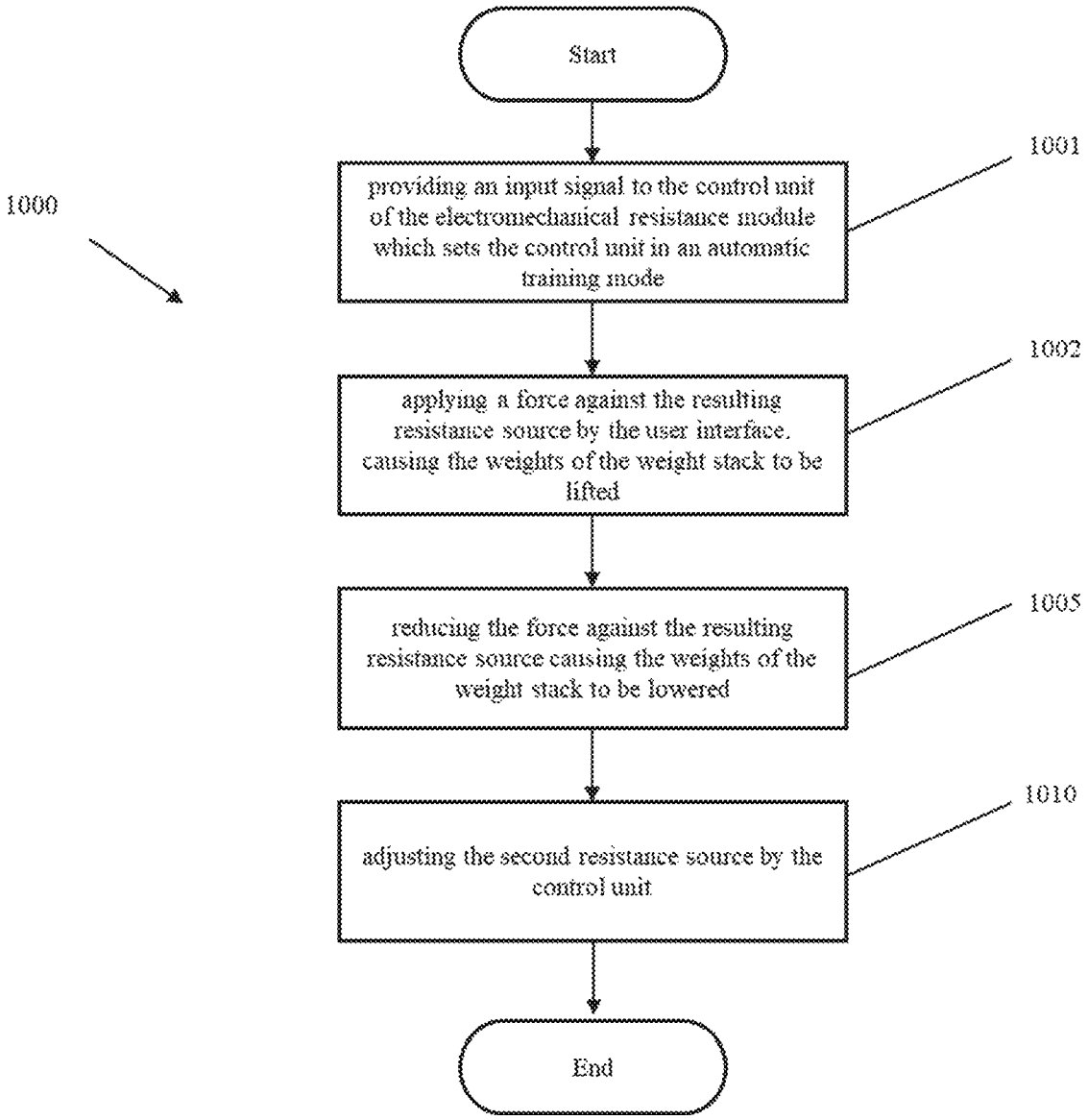
FIG. 7 shows a flowchart outlining another method for adjusting the force applied by a user to a preferred exercise machine.

FIG. 7 shows a flowchart outlining a further method 1000 for adjusting the force applied by a user to a preferred exercise machine 1. At 1001, an input signal is provided to the control unit 34 of the electromechanical resistance module 7, setting the control unit 34 in an automatic training mode. At 1002, the user applies a force against the resulting resistance source via the user interface, causing the weights of the weight stack 5 to be lifted. At 1005, the user reduces the force against the resulting resistance source, causing the weights of the weight stack 5 to be lowered. At 1010, the control unit 34 adjusts the second resistance source.

A comparison of the method 1000 described with conventional training can demonstrate the advantages of the preferred exercise machine 1.

For a lat-pulldown on a conventional power tower without the electromechanical resistance module 7, the user may start by selecting a warm-up weight, for example between 20 kg and 40 kg, depending on the user's strength and experience. After warming up, the user might perform three sets of the exercise using, for example, 60 kg of physical weight, with each set consisting of 12-15 repetitions.

During the workout, the user needs to stand up from the seated position every time they need to change the weight. This involves unhooking their thighs from under the thigh pads, stepping away from the bench, and adjusting the weights with the weight pin. The user then returns to the bench and secure their thighs under the pads again. In the final repetitions, as fatigue sets in, the user might struggle to complete the set. They could potentially perform 2-5 more repetitions and achieve maximum muscle tension if the weight could be reduced to 55 kg or 50 kg during the last few reps of the set. However, with a conventional weight system, this is not possible without interrupting the set for at least 10 seconds, including repositioning to manually change the weight.

As a result, the muscles do not perform optimally, and the time under tension is shorter than it could be if a gradual decrease in weights were possible. Additionally, constantly changing the weight every 2-3 repetitions becomes impractical and inefficient.

A preferred exercise machine 1, designed as a lat-pulldown with the electromechanical resistance module 7 on a power tower, may start similarly to traditional machines, with the user choosing a warm-up weight between 20 kg and 40 kg. The user might then select their desired training program on the electromechanical resistance module 7, in this case, drop sets, either via voice control or manually on a software application of an external device.

With the electromechanical resistance module 7, changing weights of the weight stack 5 during a set may become unnecessary. The electromechanical resistance module 7 can for example increase the electromechanical resistance equivalent to a total of 70 kg at the beginning of the exercise and gradually reduce the weight as fatigue is detected, decreasing the resistance in 1 kg increments to ensure maximum time under tension for the muscle. The user can remain seated and does not need to interrupt the set for weight changes.

Most importantly, these electromechanical resistance adjustments might be made every 2-3 repetitions while maintaining a 40 kg physical weight base, ensuring perfect visual, auditory, and inertia feedback from the weights of the weight stack 5. Additionally, the user can manually adjust the electromechanical resistance at any time by simply turning the rotation adjustment on the user interface with one finger, if they prefer different weight settings than those automatically adjusted by the module.

Another example that falls under the described method 1000 is as follows: The user can set the weights of the weight stack 5 to 40 kg for a lat-pulldown. Depending on the program (automatic training mode) they choose (for example "normal mode" or "drop set mode"), the electromechanical resistance module 7 will increase the resistance equivalent by 1 kg with every pull the user makes. This allows a gradual increase in resistance with every pull, for example, from 40 kg gradually by 1 kg up to 55 kg, without the need to switch physical weights 5.

The electromechanical resistance module 7 can operate like a pyramid, gradually increasing and decreasing the resistance within one set.

A Max-Tension Mode is designed to maximize muscle tension and engagement throughout a single set. The user selects an initial heavy physical weight 5, for example, 50 kg. The electromechanical resistance module 7 can initially be set to zero. As the user begins the set, the electromechanical resistance module 7 gradually adds resistance with each repetition (pyramid up) by an equivalent of 2 kg. This increase continues until the total weight reaches the user's one-rep max (one repetition maximum), which in this example is 90 kg. The electromechanical resistance module 7 can save the peak one-rep max amounts, so it remembers past peak one-rep max weights and builds up the pyramid until reaching a new max level.

At the peak weight (90 kg), the user experiences maximum resistance for a brief period, fully engaging the muscles. After reaching the peak, the electromechanical resistance module 7 starts decreasing the weight by 2 kg with each subsequent repetition. This reduction continues until the weight returns to zero electromechanical resistance, leaving only the physical weight 5 of 50 kg. The gradual increase and decrease in weight target different muscle fibers, enhancing overall muscle development.

Another example covered by method 1000 is as follows: in the Variable-Resistance Mode with an electromechanical resistance module 7, the resistance changes non-linearly within a single repetition. Unlike gradual or linear progression, where the resistance increases or decreases at a constant rate, this mode involves unpredictable and dynamic adjustments to the resistance at different points of the movement.

At the beginning of the repetition, the user sets the weights of the weight stack 5 at a comfortable level, for example, 50 kg. As the single movement/repetition progresses, the electromechanical resistance module 7 detects the muscle's engagement and adjusts the resistance accordingly. During the midpoint of the repetition, the resistance can increase or decrease sharply. These changes can be programmed to vary in intensity and duration, creating a challenging environment for the muscles. Towards the end of the repetition, the resistance can either taper off or spike based on the preset program. This unpredictability ensures that the muscles are constantly adapting to the changing resistance. The non-linear changes in resistance force the muscles to respond to varying loads, leading to greater muscle activation. The unpredictable nature of the resistance changes helps prevent plateaus in training. Muscles must constantly adapt to new challenges, promoting continuous improvement and growth. By varying the load throughout the repetition, the stress on joints and tendons can be minimized, reducing the risk of overuse injuries common with constant or linear resistance training.

Repetition refers to the number of times a user performs a specific exercise movement consecutively in a set, while a set refers to a specific number of repetitions of a particular exercise performed consecutively without rest.

Figure 8:
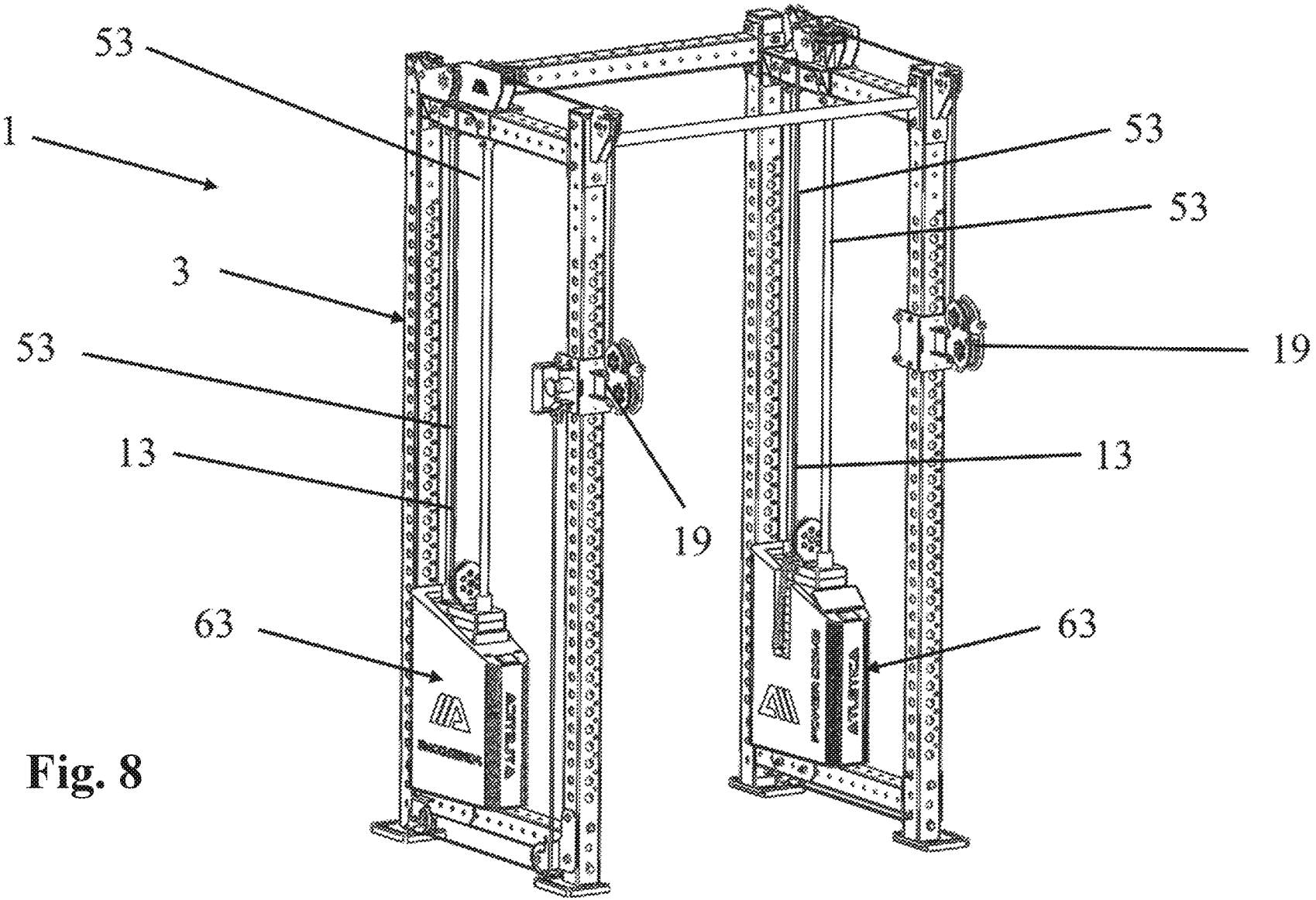
FIG. 8 shows a preferred embodiment of the exercise machine in a perspective view.

FIG. 8 shows a preferred embodiment of an exercise machine 1 in a perspective view. The exercise machine 1 is designed as a power rack, with a body 3 formed in particular by frame elements. The exercise machine 1 includes two hybrid resistance generation systems 63. These systems 63 are each positioned at the base of the body 3, between two rod tubes 53 of the exercise machine 1, which serve to guide the weight stacks 5 of the hybrid resistance generation systems 63. Each hybrid resistance generation system 63 is connected to a first cable 13.

Additionally, the exercise machine 1 features pulleys 19 attached to the body 3, which guide the first cables 13 to a user interface where the user can apply force against the resulting resistance. The user interface, which is attached to the first cable 13, is not shown in the figure.

Figure 9:
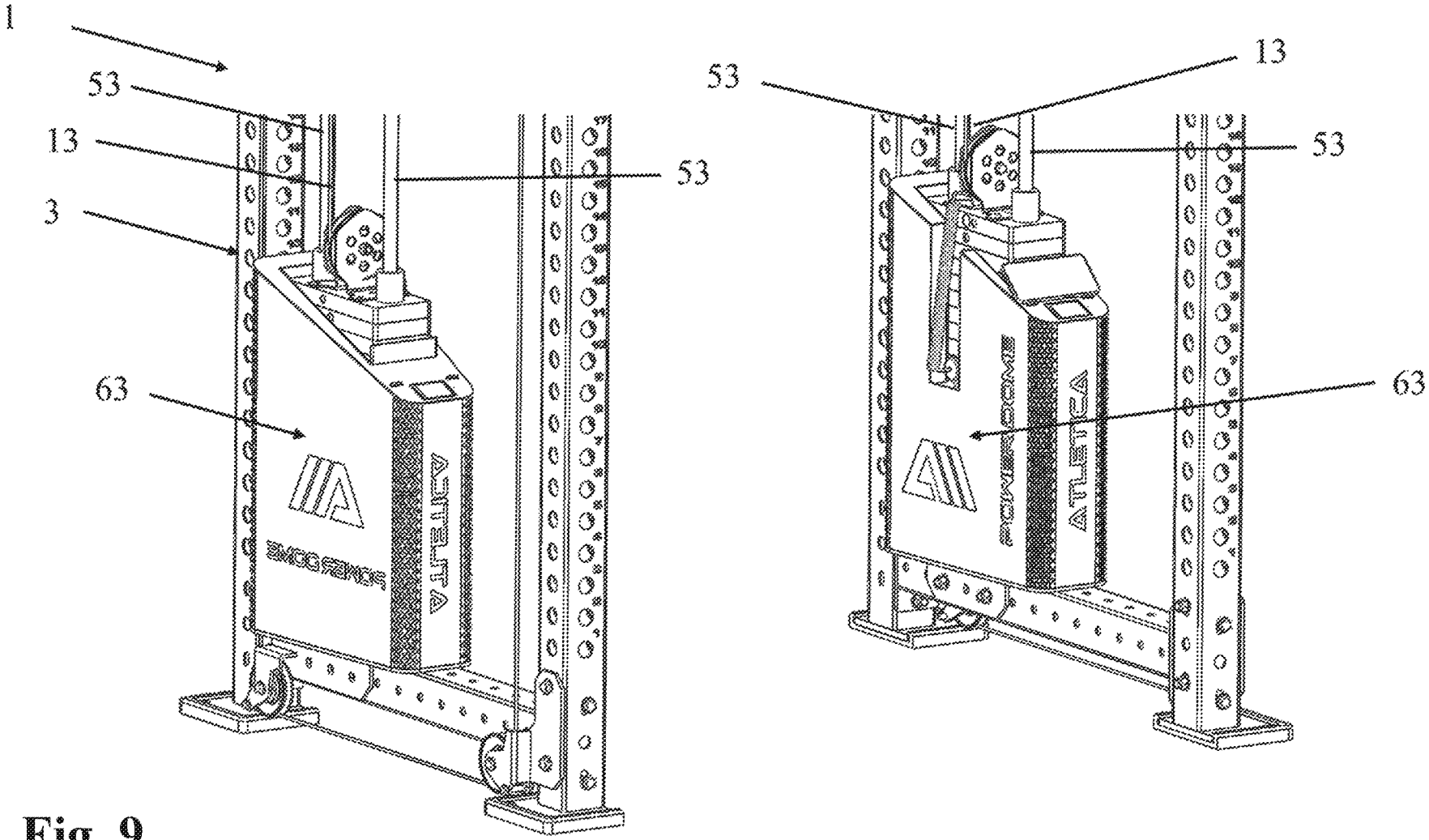
FIG. 9 shows a partial view of a preferred embodiment of the exercise machine, particularly two hybrid resistance generation systems.
Figure 10:
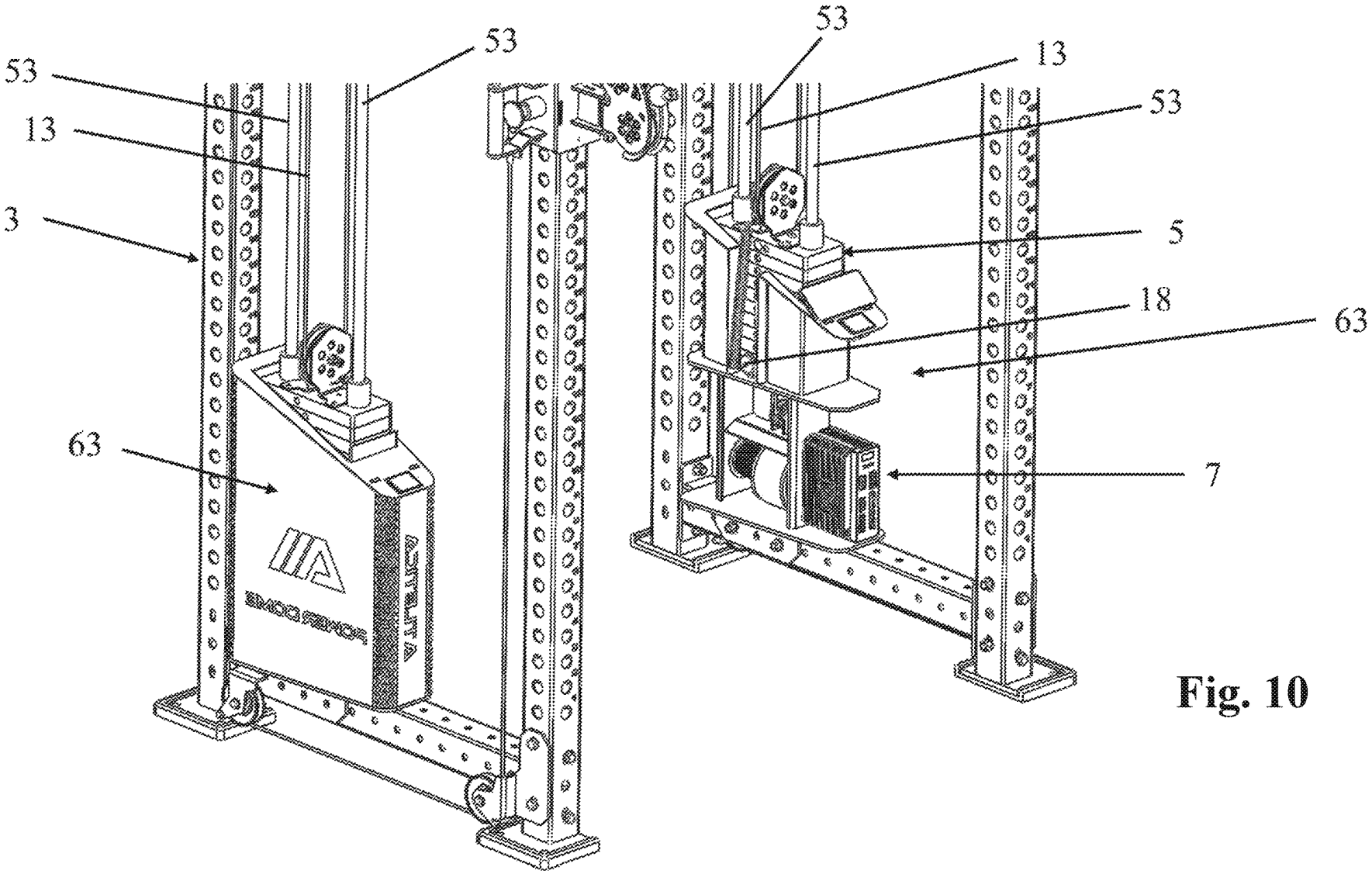
FIG. 10 shows a partial view of a preferred embodiment of the exercise machine, particularly two hybrid resistance generation systems.

FIG. 9 and FIG. 10 each show a partial view of a preferred embodiment of the exercise machine 1, particularly the two hybrid resistance generation systems 63. Both figures represent detailed sections of FIG. 8, and thus reference is made to the descriptions provided for FIG. 8 for further context.

In particular, FIG. 10 shows a view where the housing 64 of one of the hybrid resistance systems 63 has been removed. This reveals the weight stack 5 and the electromechanical resistance module 7, which are separated by an intermediate level or wall.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

What is claimed is:

1. A hybrid resistance generation system for an exercise machine, comprising:

a housing;

a sensor system;

a weight stack with a plurality of weights that can be coupled with a weight sword providing a first resistance source; and an electromechanical resistance module providing a second resistance source;

wherein the first resistance source and the second resistance source are connected in series, so that a resulting resistance source is applied to a first cable, which is coupled to the weight sword; and wherein a first end of a second cable is connected to a bottom end of the weight sword, a second end of the second cable is connected to the electromechanical resistance module, and the second cable is located entirely below the weight sword.

2. The hybrid resistance generation system of claim 1, wherein the housing comprises at least two chambers.

3. The hybrid resistance generation system of claim 2, wherein the weight stack is located in a first chamber and the electromechanical resistance module is located in a second chamber.

4. The hybrid resistance generation system of claim 2, wherein the electromechanical resistance module comprises an electric motor with a winch on which the second cable can be wound and unwound.

5. The hybrid resistance generation system of claim 4, wherein the electric motor is designed as a brushless outrunner motor.

6. The hybrid resistance generation system of claim 4, wherein the weight stack is located in a first chamber, the electric motor is located in a second chamber, and the winch is located in a third chamber.

7. The hybrid resistance generation system of claim 6, wherein the second chamber or the third chamber are located below the first chamber.

8. The hybrid resistance generation system of claim 1, wherein the hybrid resistance generation system further comprises at least one pulley which guides the second cable to the weight sword of the weight stack.

9. The hybrid resistance generation system of claim 1, wherein the electromechanical resistance module comprises a control unit with a data processing unit for controlling the second resistance source and a communication unit for data communication.

10. The hybrid resistance generation system of claim 9, wherein the hybrid resistance generation system further comprises at least one display which can display data processed by the control unit of the electromechanical resistance module or a control unit of the sensor system.

11. The hybrid resistance generation system of claim 1, wherein the sensor system is configured to acquire a resistance of the first resistance source, the second resistance source, the resulting resistance source, a movement of the weight stack or the weight sword, or a movement of the first cable.

12. The hybrid resistance generation system of claim 1, wherein the sensor system comprises a laser device, and wherein the laser device is positioned either below a lowermost weight plate of the weight stack or above a plate of the weight sword and is directed to a pin of the weight stack, the laser device being configured to emit a laser beam towards the pin and to analyze a reflection of the laser beam on the pin.

13. A An exercise machine, comprising:

a body;

b. the hybrid resistance generation system of claim 1; and c. at least one pulley which is attached to the body guiding the first cable to a user interface for applying a force against the resulting resistance source, wherein the user interface is attached to the first cable.

14. The exercise machine of claim 13, wherein the electromechanical resistance module and the sensor system are in data communication with an external device having a data processing unit and a communication unit;

wherein the sensor system comprises means for providing acquired data to the external device;

wherein the user interface comprises means for providing an input signal to the external device; and wherein the external device is configured to process the provided acquired data of the sensor system and the provided input signal of the user interface and to transmit control commands to the electromechanical resistance module.

15. A method for adjusting the force to be applied by the user to the exercise machine of claim 14, the method comprising the following steps:

i. applying the force against the resulting resistance source by the user interface;

ii. acquiring a movement of the plurality of weights of the weight stack, in particular a speed or an acceleration of the movement, by the sensor system;

iii. providing the acquired data of the sensor system to a control unit of the electromechanical resistance module;

iv. detecting by the control unit a decrease in the speed or the acceleration in relation to previously acquired data by the sensor system; and v. adjusting the second resistance source by the control unit.

16. A method for adjusting the force to be applied by the user to the exercise machine of claim 14, the method comprising the following steps:

i. applying the force against the resulting resistance source by the user interface;

ii. providing the input signal to a control unit by the user interface; and iii. adjusting the second resistance source by the control unit.

17. A method for adjusting the force to be applied by the user to the exercise machine of claim 14, the method comprising the following steps:

i. providing the input signal to a control unit of the electromechanical resistance module which sets the control unit in an automatic training mode;

ii. applying the force against the resulting resistance source by the user interface, causing the plurality of weights of the weight stack to be lifted;

iii. reducing the force against the resulting resistance source causing the plurality of weights of the weight stack to be lowered; and iv. adjusting the second resistance source by the control unit.

* * * * *